US006145930A

United States Patent [19]

Su

[11] Patent Number: 6,145,930

[45] Date of Patent: Nov. 14, 2000

[54] ADJUSTMENT DEVICE FOR THE BACK OF A CHAIR

[76] Inventor: Wen-Fa Su, No. 26, Hsing Ya Rd., Chia Yi, Taiwan

[21] Appl. No.: 09/500,032

[22] Filed: Feb. 8, 2000

[51] Int. Cl.[7] ..... A47C 1/025

[52] U.S. Cl. ..... 297/367; 297/362

[58] Field of Search ..... 297/301.1, 301.4, 297/366, 367, 362, 378.12

[56] References Cited

U.S. PATENT DOCUMENTS

| | | | |
|---|---|---|---|
| 3,931,996 | 1/1976 | Yoshimura | 297/367 |
| 5,718,481 | 2/1998 | Robinson | 297/367 |
| 5,899,533 | 5/1999 | Tatematsu et al. | 297/367 |
| 6,007,153 | 12/1999 | Benoit et al. | 297/367 |

*Primary Examiner*—Peter R. Brown
*Attorney, Agent, or Firm*—Rosenberg, Klein & Lee

[57] ABSTRACT

An adjustment device for a chair back comprises a fixed member, a frame member, an engaging member and a controlling member. The fixed member is fixed to a bottom of the seat, and has a toothed portion projecting out from the seat. The frame member is fixed to the chair back. The frame member is pivoted to the fixed member, and has a cog rotatably disposed on said toothed portion. A spring is connected to both the fixed member and the frame member to bias the frame member and the chair back toward the seat. The engaging member is movably disposed on the cog. A steel rope is connected to the controlling member and the engaging member such that the engaging member can separate from the cog for permitting the frame member to be pivoted on the fixed member, and let the chair back to be adjusted when the controlling member is moved.

1 Claim, 10 Drawing Sheets

ADJUSTMENT DEVICE FOR THE BACK OF A CHAIR

BACKGROUND OF THE INVENTION

Chairs having an adjustable back are popular because the sitter can adjust the back to a desired position for him/her to sit on the chair comfortably.

Many adjustment devices for a chair back have been devised, each of them having its own features, such as those disclosed in U.S. Pat. No. 5,169,257, U.S. Pat. No. 4,294,488, U.S. Pat. No. 5,590,932 and No. U.S. Pat. No. 5,205,609.

The present invention is aimed to provide an adjustment device for a chair back, of which the design is different from the above said prior art ones.

SUMMARY OF THE INVENTION

It is a main object of the present invention to provide an adjustment device for a chair back such that a user can adjust the chair back easily.

The adjustment device for a chair back comprises:

a fixed member fixed to a bottom of a seat of the chair, the fixed member has a toothed portion on a rear end portion projecting out from the seat;

a frame member fixed to the chair back; the frame member is pivoted to the rear end portion of the fixed member; the frame member has a cog rotatably disposed on the toothed portion of the fixed member; a spring is provided to connect both the fixed member and the frame member for biasing the chair back toward the seat;

an engaging member movably connected to the frame member, a second spring is connected to both the frame member and the engaging member for forcing the engaging member to engage the cog; the cog cannot rotate, and the frame member cannot be pivoted when the engaging member engages the cog;

a connecting rod member movably connected to the frame member; a steel rope is connected to the controlling member and the engaging member such that the controlling member can be moved to force the engaging member to separate from the cog for permitting the frame member and the seat back to be adjusted.

BRIEF DESCRIPTION OF THE DRAWINGS

The present invention will be better understood by reference to the accompanying drawings, wherein.

DESCRIPTION OF THE PREFERRED EMBODIMENTS

Figure 1:
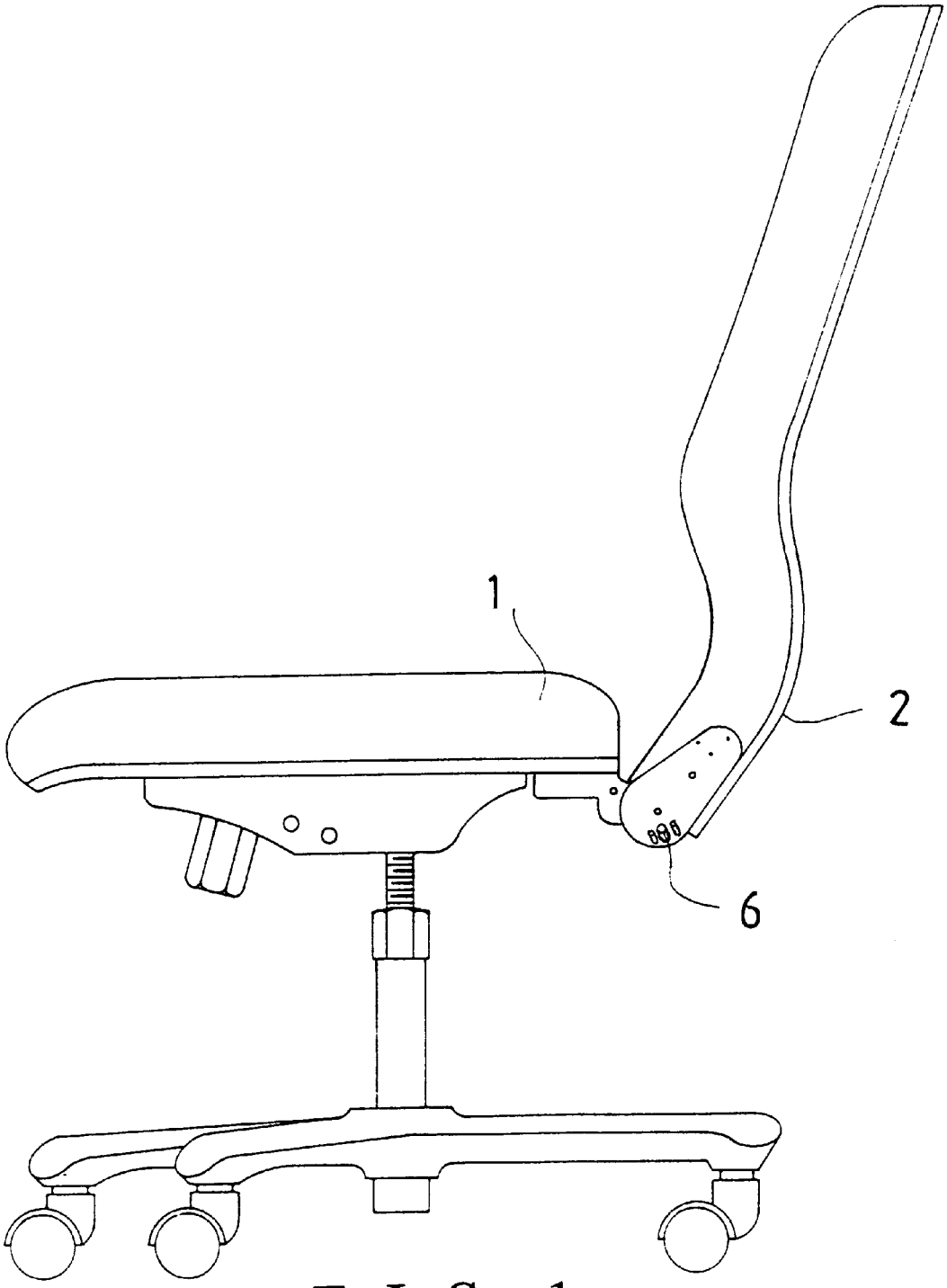
FIG. 1 is a view showing the appearance of a chair provided with the adjustment device for a chair back according to the present invention.

A Referring to FIG. 1, an adjustment device for the back of a chair is fitted between a seat 1 and a back 2 of the chair.

Figure 2:
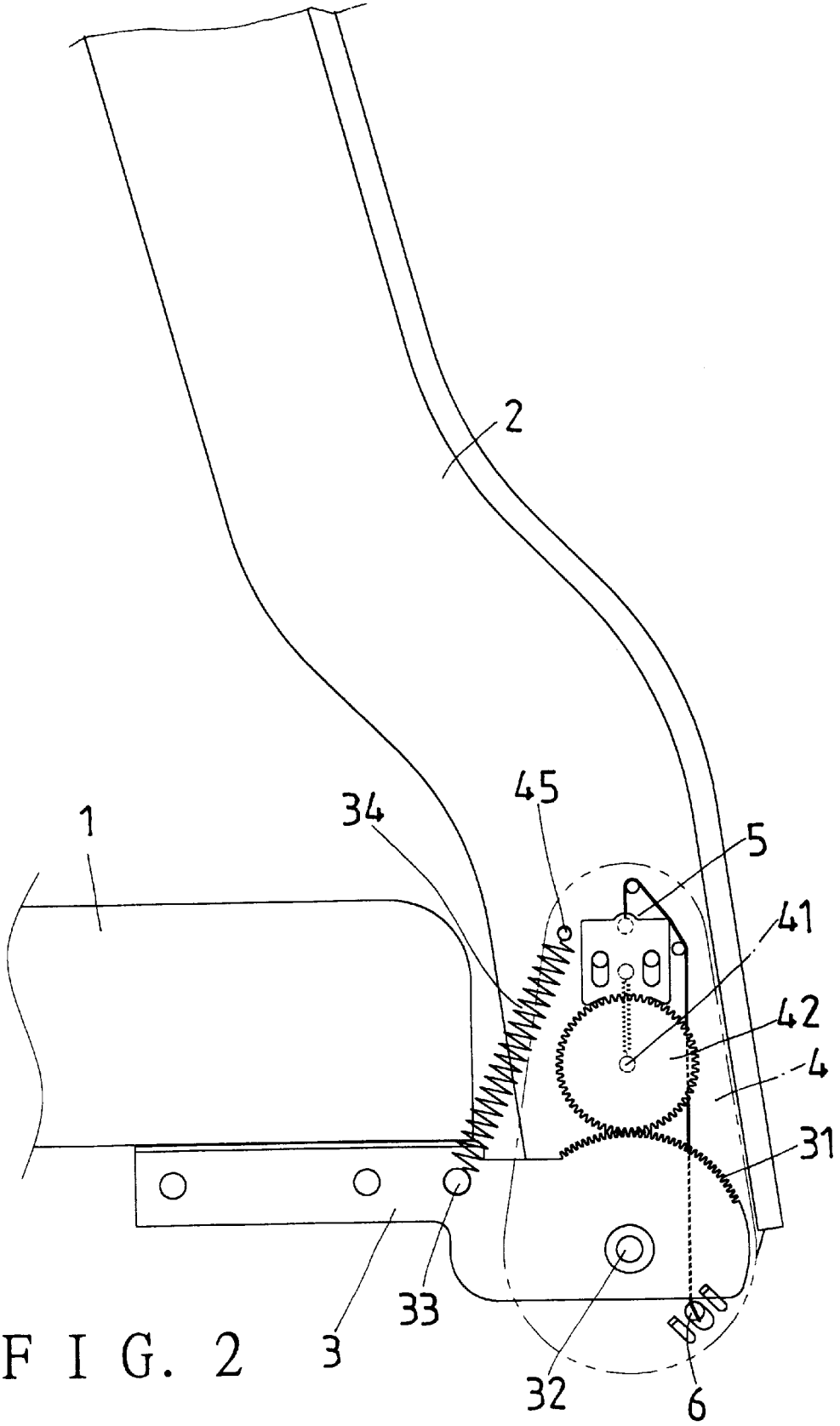
FIG. 2 is a cross-sectional view of an adjustment device for a chair back according to the first embodiment of the present invention.
Figure 4:
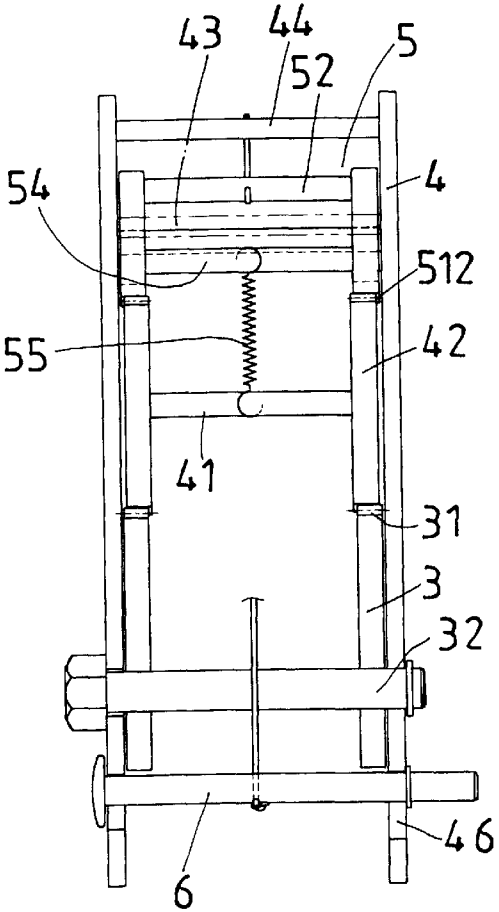
FIG. 4 is another cross-sectional view of the adjustment device in FIG. 2.
Figure 3:
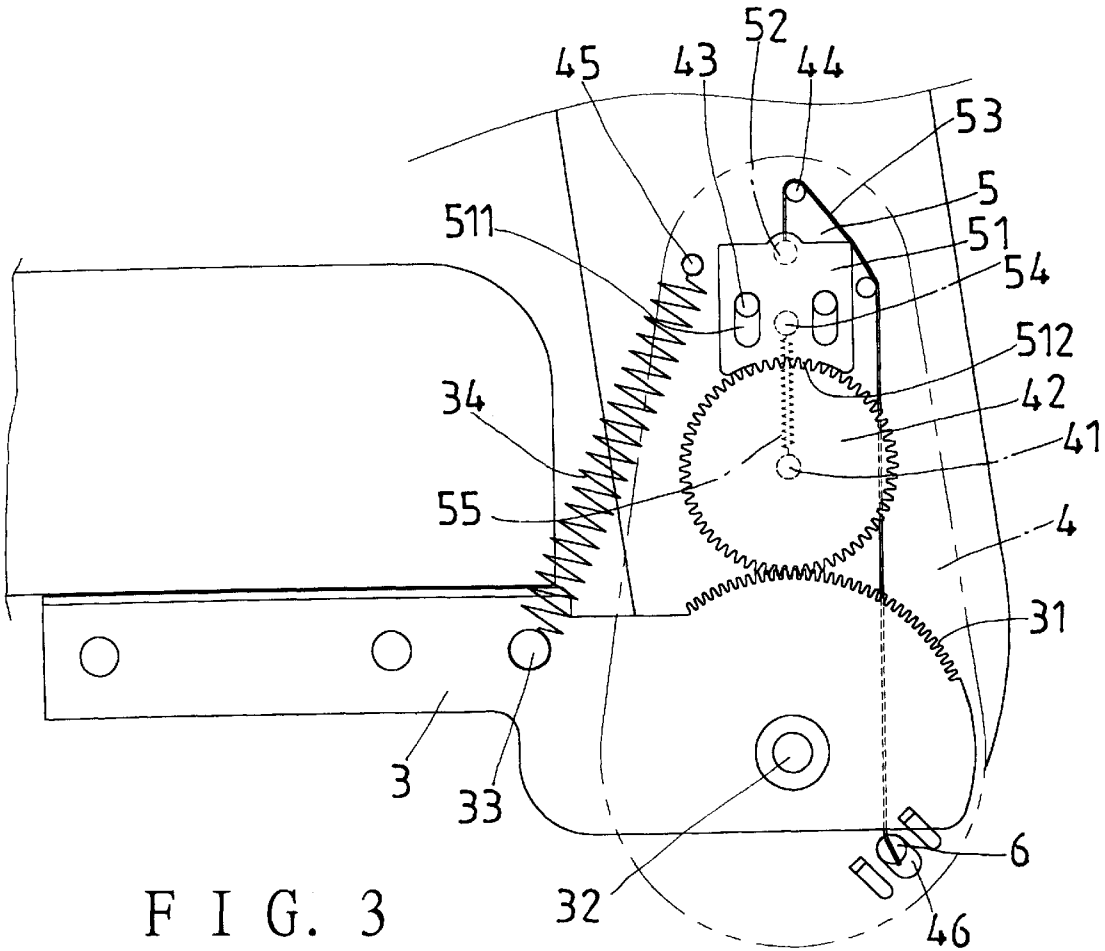
FIG. 3 is a cross-sectional view of the adjustment device in FIG. 2.

The adjustment device, referring to FIGS. 2–4, comprises a fixed member 3, a frame member 4, an engaging member 5 and a controlling member 6. The fixed member 3 is fixed to a bottom of the seat 1 of the chair from a front portion thereof The fixed member 3 has a toothed portion 31 on a rear part thereof. A pivot rod 32 is fixed to the rear part of the fixed member 3. The fixed member 3 further has a locating rod 33, to which a spring 34 is connected from a lower end thereof.

The frame member 4 is fixed to the back 2 of the chair. The frame member 4 is pivoted to the pivot rod 32 from a lower part thereof. The frame member 4 has a first rod 41. A cog 42 is rotatably connected to the first rod 41 with teeth of the cog 42 engaging the toothed portion 31 of the fixed member 3 such that the cog 42 can move on the toothed portion 31 when the frame member 4 further has a second rod 45, to which an upper end of the spring 34 is connected such that the spring 34 can bias the frame 4 toward the seat 1 of the chair. The frame member 4 further has several support rods 44 and two guide rods 43 on an upper portion, and has an elongated hole 46 on a lower portion.

Figure 5:
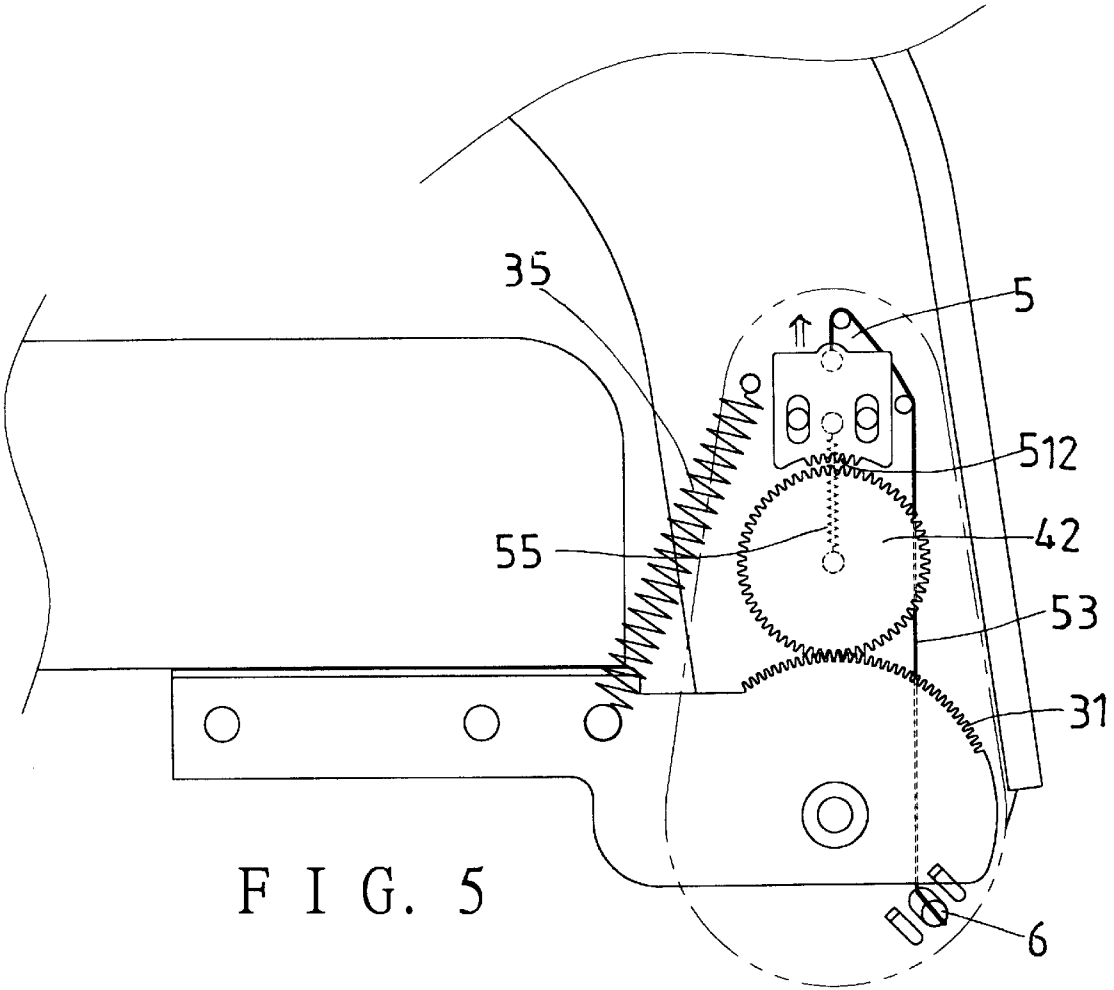
FIG. 5 is a cross-sectional view of the adjustment device in FIG. 2 with the engaging member separated from the cog.
Figure 7:
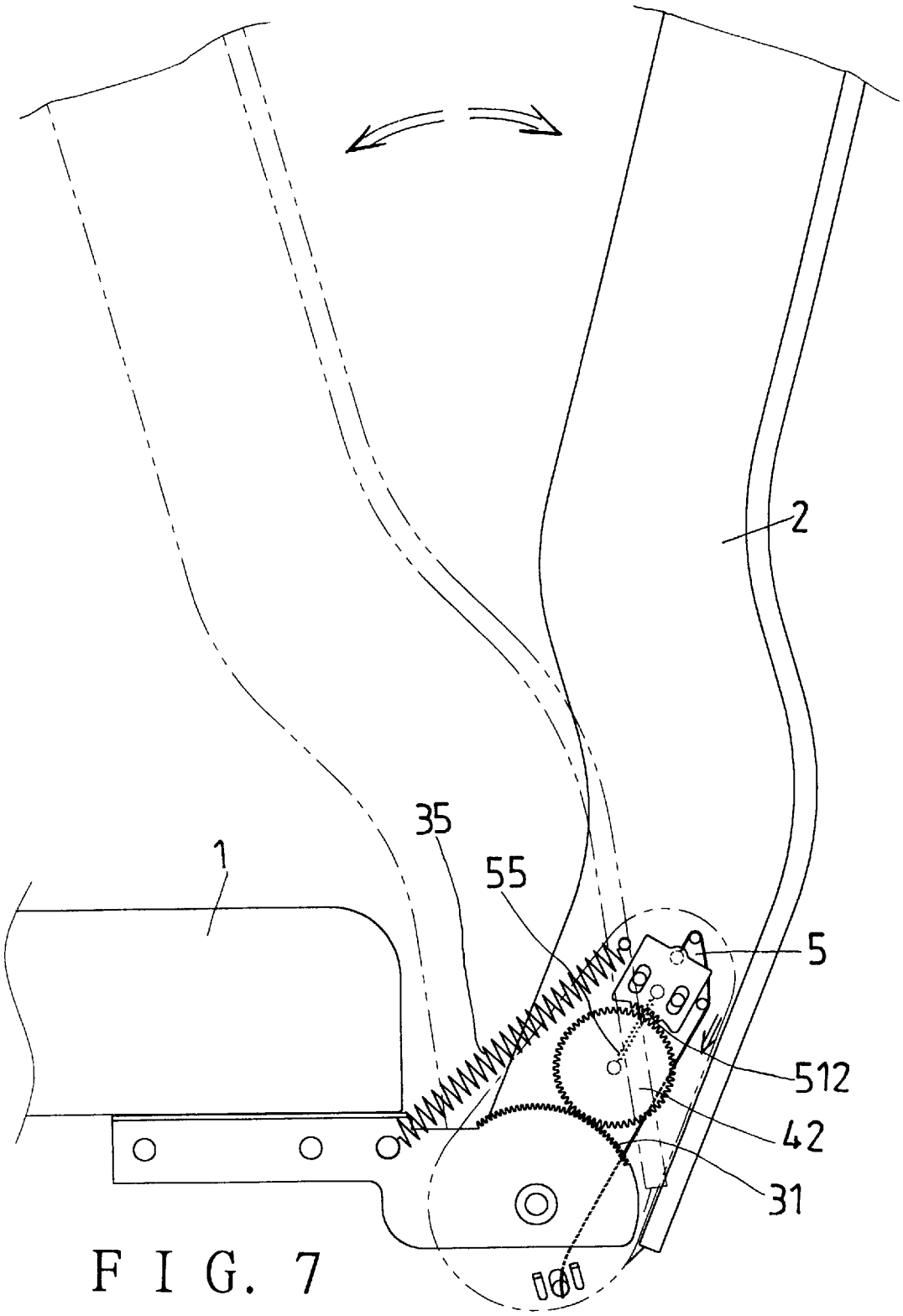
FIG. 7 is a view of the adjustment device in FIG. 2 under the adjustment movement.

The engaging member 5 has stopping teeth 512, as shown in FIG. 5, two elongated holes 511, a first connecting rod 52, a second connecting rod 54 on a main body 51 thereof. The main body 51 of the engaging member 5 is disposed above the cog 42 with the stopping teeth 512 opposing the teeth of the cog 42. The elongated holes 511 each receives a respective one of the guide rods 43 of the frame member 4 such that the main body 51 can make a movement, which is confined by the elongated holes 511 thereof. A second spring 55, as shown in FIG. 3, is connected to both the first rod 41 of the frame member 4 and the second connecting rod 54 of the engaging member 5 such that the spring 55 can bias the main body 51 downwardly for the stopping teeth 512 of the main body 51 to engage the cog 42. The engaging member 5 further has a steel rope 53. The steel rope 53 is connected to the first connecting rod 52 from an upper end, and is supported by the support rods 44 of the frame member 4.

Figure 6:
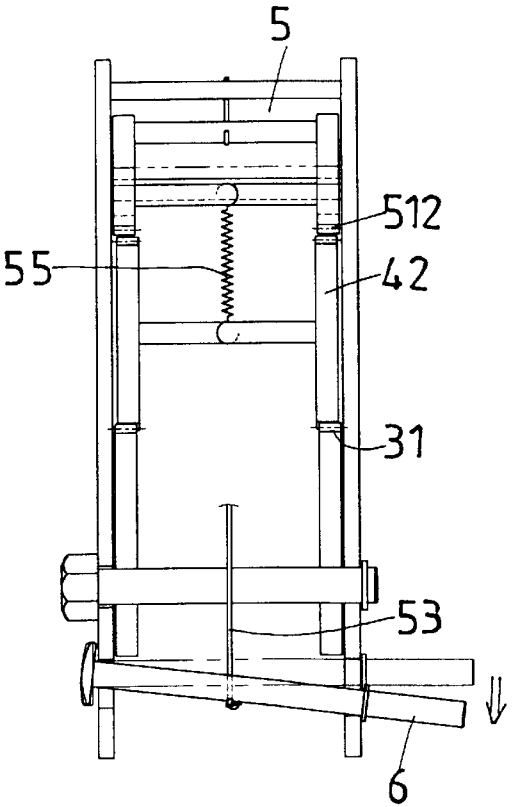
FIG. 6 is a view of the adjustment device in FIG. 2, with the controlling member being depressed.

The controlling member 6 is shaped like a rod, and passed through the elongated hole 46 of the frame member 4. The steel rope 53 is connected to the controlling member 6 from a lower end such that when the controlling member 6 is depressed, as shown in FIGS. 5 and 6, the steel rope 53 is pulled downwards, forcing the main body 51 of the engaging member 5 to move upwards.

In using the adjustment device to adjust the chair back, the controlling member 6 is depressed to lift to main body 51 of the engaging member 5 for the stopping teeth 512 to separate from the cog 42. Thus, the chair back and the frame member 4 can be pivoted to a desired position because the cog 42, being currently not stopped from rotating by the engaging member 5, can move on the toothed portion 31 of the fixed member 3. When the chair back is pivoted to a desired position, the controlling member 6 is released, permitting the main body 51 to be pulled down by the second spring 55; thus, the stopping teeth 512 engage the cog 42 again to fix the frame member 4, and the chair back in position.

Figure 8:
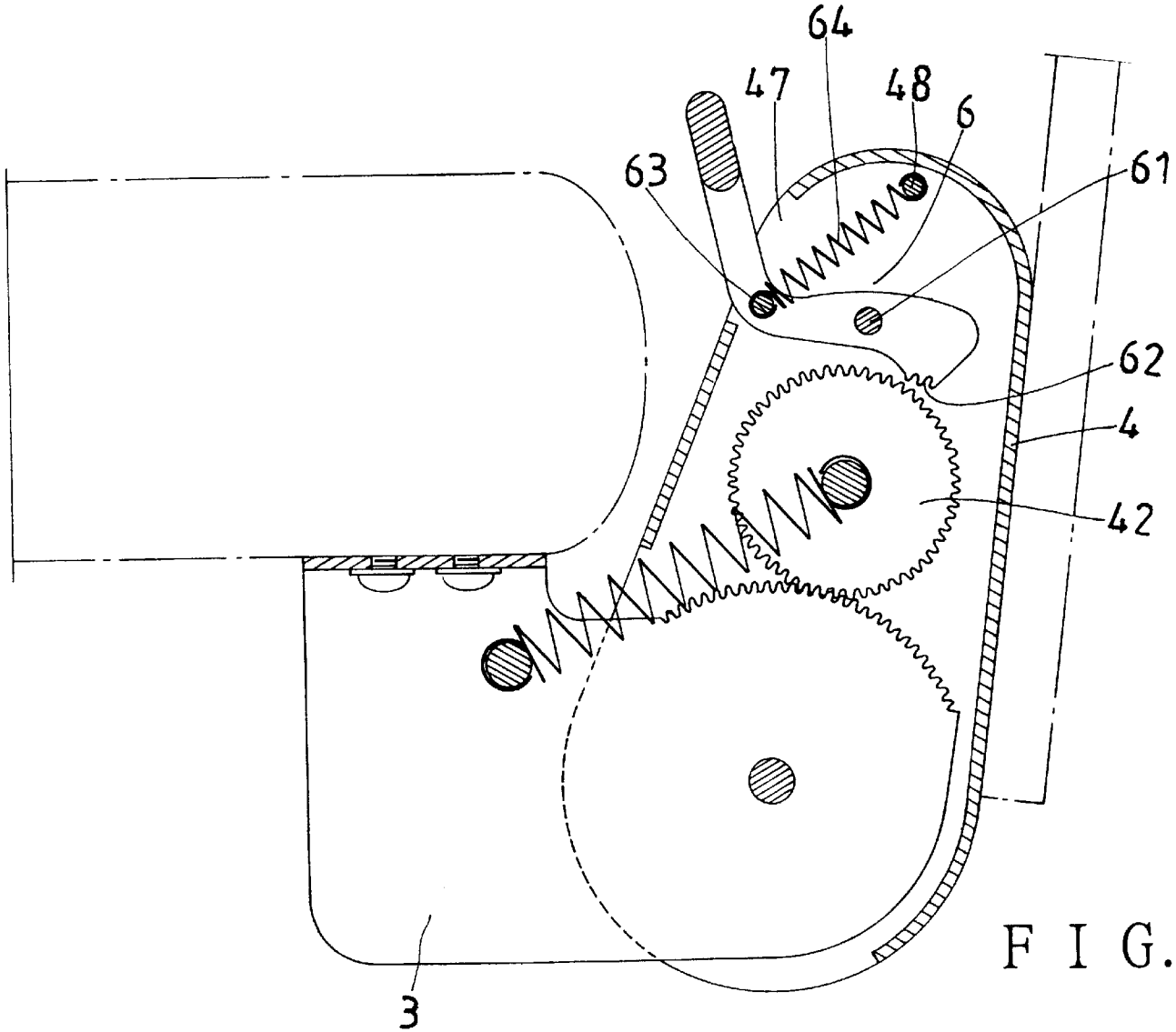
FIG. 8 is a cross-sectional view of the adjustment device according to the second embodiment of the present invention.
Figure 9:
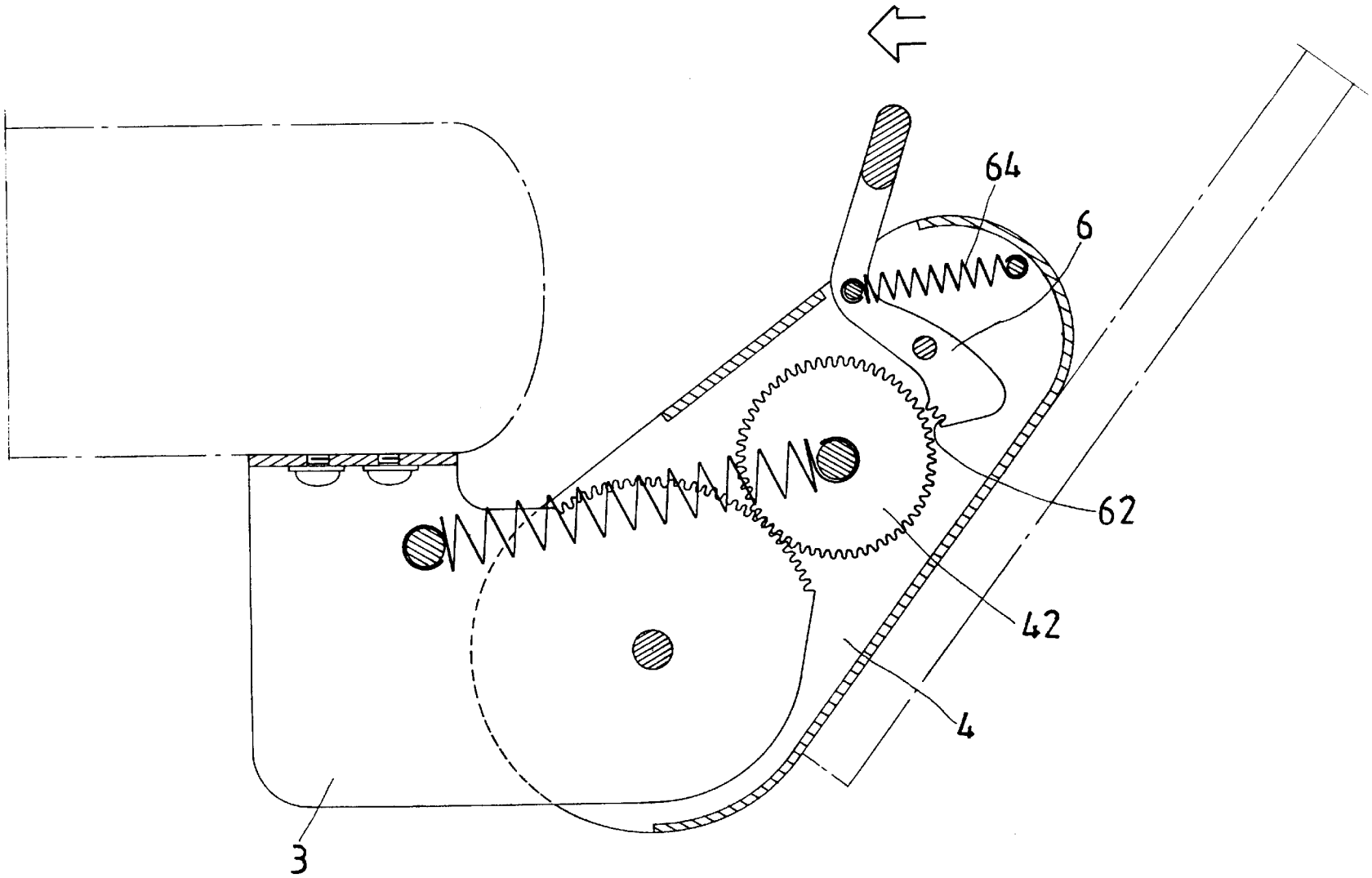
FIG. 9 is a cross-sectional view of the adjustment device in FIG. 8, with the controlling lever being pushed.

In a second embodiment of the present invention, referring to FIG. 8, the adjustment device for the back of a chair comprises a fixed member 3, a frame member 4 and a controlling member 6. The fixed member 3 and the frame member 4 are basically the same as those of the last embodiment. A first spring is connected to the frame member 4 and the fixed member 3 to bias the frame member 4 and the chair back toward the chair seat. The controlling member 6 is a bent lever having stopping teeth 62 on an inner end, and is pivoted to a pivot rod 61 fixed to the frame member 4. A second spring 64 is connected to a locating rod 48 of the frame member 4 and an intermediate rod 63 of the controlling member 6 such that the second spring 64 can bias the controlling member 6 for the stopping teeth 62 to engage the teeth of the cog 42 pivoted to the frame member 4. The controlling member 6 has an outer end portion projecting out from the frame member 4 such that a user can reach same to adjust the chair back. When the controlling member 6 is depressed from the outer end portion, the stopping teeth 62 will separate from the cog, permitting the cog to rotate on the toothed portion of the fixed member 3. Thus, the frame member 4 and the chair back can be pivoted on the fixed member 3 to desired position. When the controlling member 6 is released, the second spring 64 will force the stopping teeth 62 of the controlling member 6 to engage the cog 42 again to fix the frame member 4 and the chair back in position.

Figure 10:
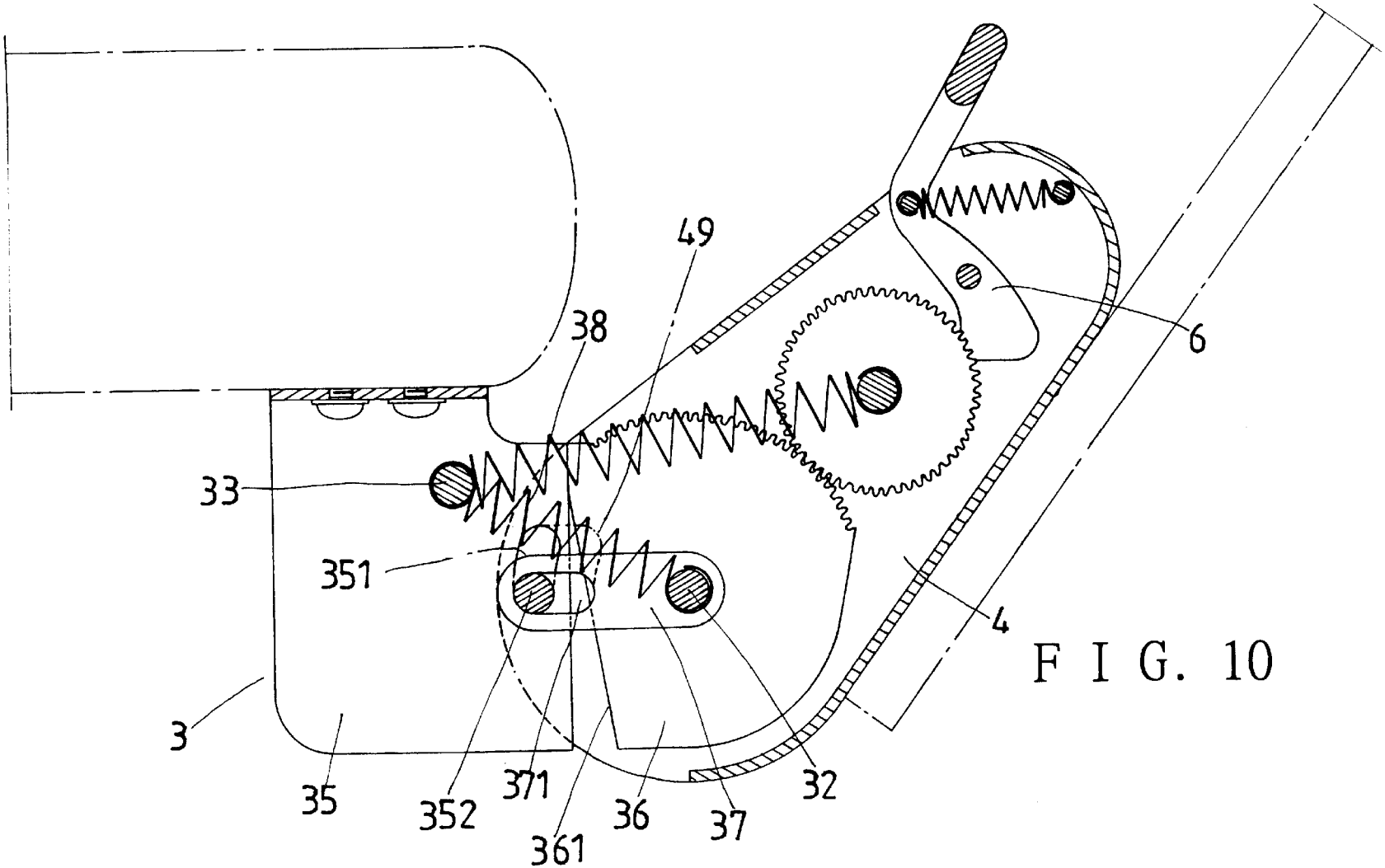
FIG. 10 is a cross-sectional view of the adjustment device according to the third embodiment of the present invention.
Figure 11:
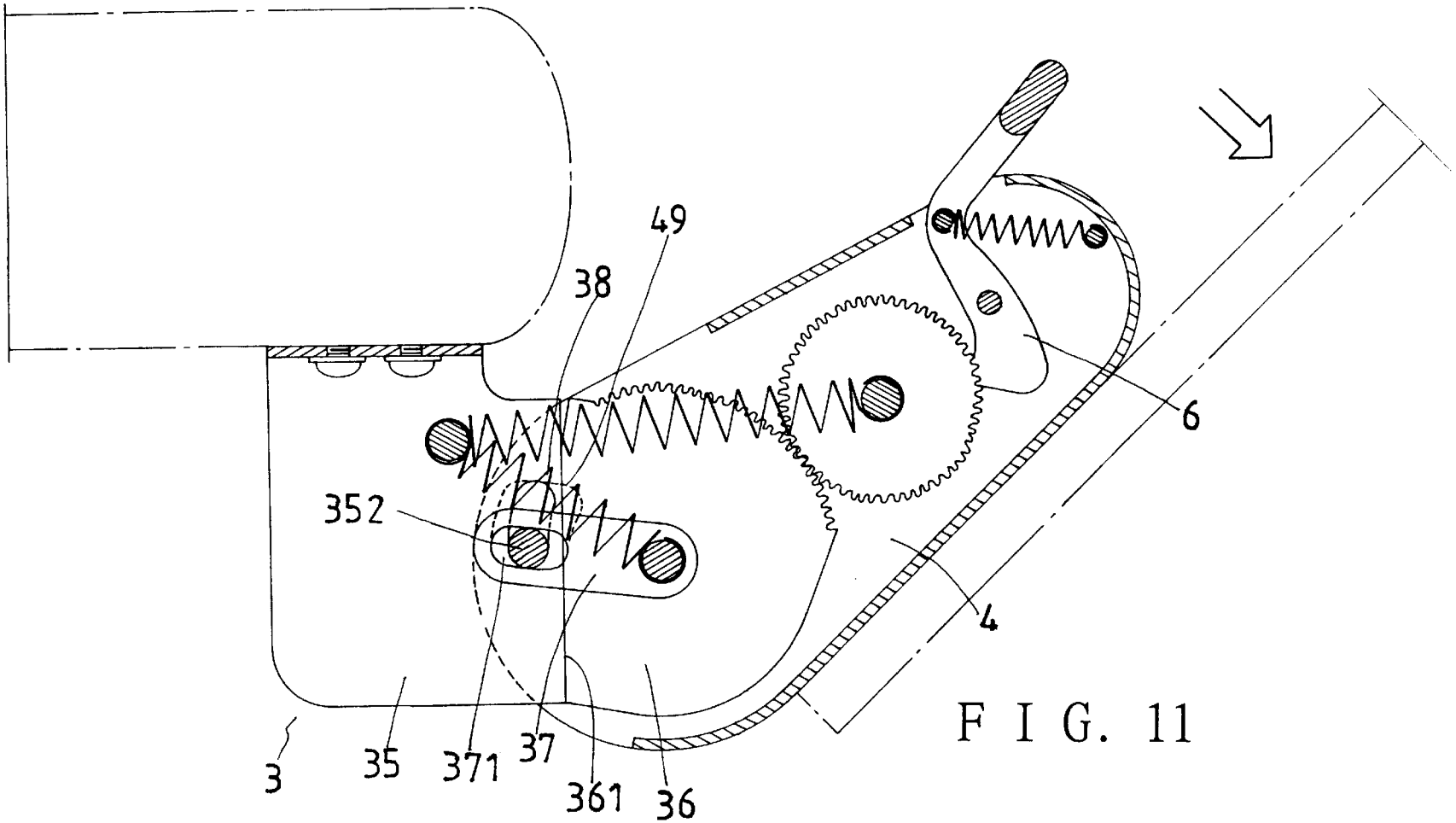
FIG. 11 is a cross-sectional view of the adjustment device in FIG. 10 under the adjustment movement.

In a third embodiment of the present invention, referring to FIG. 10, the fixed member 3 is made to have two separate parts, a front fixed part 35 and a rear part 36 disposed adjacent to the front part 35. The rear part 36 has a slope 361. The front fixed part 35 has a curved hole 351 on a rear portion thereof. A fixing rod 352 is passed into the curved hole 351 of the front fixed part 35. The frame member 4 has a moving hole 49. The fixing rod 352 is also passed into the moving hole 49. A connecting plate 37 is provided; the connecting plate 37 has a rear end connected to the pivot rod 32, and a front end having an elongated hole 371; the fixing rod 352 is also passed into the elongated hole 371. Thus, when the controlling member 6 is moved for the chair back to be adjustable, the frame member 4 and the connecting plate 37 can move relative to the fixing rod 352 due to both the moving hole 49 and the elongated hole 371. When the slope 361 of the rear part 36 contact the front fixed part 35, the chair back can no longer be pivoted, i.e. the slope 361 can confine the position of the chair back. When the controlling member 6 is released, the springs will force the frame member 4 and the chair back toward the chair seat as described in the earlier embodiments.

Figure 12:
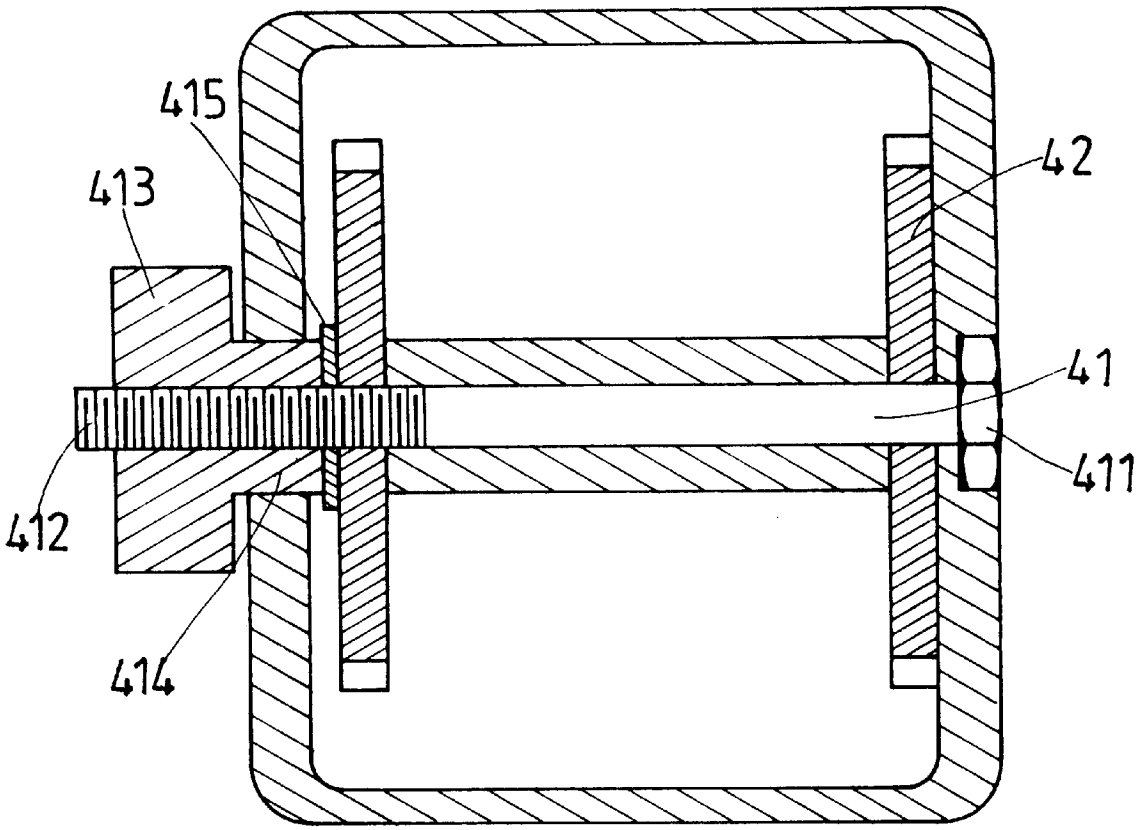
FIG. 12 is a cross-sectional view of the cog, the pivot rod and the e member according to the fourth embodiment of the present invention.

In a fourth embodiment of the present invention, referring to FIG. 12, the first rod 41 is further provided with a head 411, a threaded end portion 412 and a nut 413. The head 411 is located on one side of the frame member 4 and the threaded end portion 412 passed through other side of the frame member 4. The nut 413 has an extended portion 414, and is screwed onto the threaded end portion 412 with the extended portion 414 disposed inwardly of the frame member 4. A stopping disc 415 is disposed between the cog 42 and the extended portion 414 of the nut 413 such that the stopping disc 415 can stop the cog 42 from rotating when the nut 413 is screwed tightly into the frame member 4. To adjust the frame member 4 and the chair back, the user has to screw the nut outwardly of the frame member 4.

From the above description, the adjustment device for a chair back of the present invention discloses desirable features that the chair back can become adjustable by only moving the controlling member 6, and the nut 413 and the stopping chip 415 can be used alone or together with the engaging member to fix the frame member and the chair back in position.

What is claimed is:

1. An adjustment device for a back of a chair, comprising:

(a) a fixed member, said fixed member being coupled to a bottom of a seat of said chair from a front portion thereof; said fixed member having a toothed portion on a rear part thereof, (b) a frame member fixed to said chair back, said frame member being pivoted to said rear part of said fixed member; said frame member having a cog fitted on a rod, said cog being rotatably disposed on said toothed portion of said fixed member; said frame member being biased toward said seat by a first spring connecting both said fixed member and said frame member;

(c) an engaging member movably connected to said frame member; a second spring being connected to both said engaging member and said frame member for forcing said engaging member to engage said cog; said engaging member having stopping teeth capable of engaging said cog for preventing said cog from rotating when said engaging member is biased to connect said cog by said second spring;

(d) a controlling rod member, said controlling member being movably connected to said frame member; a steel rope being connected to said engaging member and said controlling member such that said controlling member can be moved to force said engaging member to separate from said cog for said stopping teeth of said engaging member to disengage from said cog; said chair back and said frame member being capable of being pivoted relative to said chair seat when said stopping teeth disengage from said cog.

* * * * *